US005957015A

United States Patent [19]

Jackson

[11] Patent Number: 5,957,015

[45] Date of Patent: Sep. 28, 1999

[54] CLUTCH TENSION ADJUSTMENT TOOL

[76] Inventor: Lawrence Jackson, 13642 Brown St., Walker, La. 70785

[21] Appl. No.: 08/933,617

[22] Filed: Sep. 8, 1997

[51] Int. Cl.[6] ..... B25B 11/00

[52] U.S. Cl. ..... 81/484; 29/274; 81/488

[58] Field of Search ..... 81/484, 488; 29/274

[56] References Cited

U.S. PATENT DOCUMENTS

| | | | |
|---|---|---|---|
| 2,487,504 | 11/1949 | Yelkin . | |
| 3,896,686 | 7/1975 | Swinney | 81/180.1 |
| 4,255,839 | 3/1981 | Shea . | |
| 4,916,792 | 4/1990 | Haubus . | |
| 5,295,291 | 3/1994 | Harris . | |
| 5,404,774 | 4/1995 | Bond | 81/81 |

*Primary Examiner*—David A. Scherbel
*Assistant Examiner*—Sinclair Skinner
*Attorney, Agent, or Firm*—Joseph N. Breaux

[57] ABSTRACT

A clutch tension adjustment tool for adjusting the tension on clutches that have a threaded aperture into a clutch pressure plate and a clutch adjustment ring for adjusting the tension of the clutch. The clutch tension adjustment tool includes an elongated tool handle having a padded hand grip; a bolt slot plate with an elongated bolt slot; an S-shaped connecting bar integrally formed between the tool handle and the bolt slot plate; a clutch adjustment ring insertion pin extending downwardly and away from a far end of the bolt slot plate; and a spring biased, slidable clutch plate connecting pivot bolt assembly slidably mounted through the bolt slot, the spring biased, slidable clutch plate connecting pivot bolt assembly including a pivot bolt with a threaded end portion, a moveable top washer, a moveable biasing spring, a moveable middle washer, and a fixed bottom washer; the threaded end portion of the pivot bolt being inserted through the moveable top washer, the moveable biasing spring, the moveable middle washer, the elongated bolt slot of the bolt slot plate and the fixed bottom washer, the fixed bottom washer being welded to a midpoint of the pivot bolt in a manner to allow at least a section of the threaded end portion to protrude past the fixed bottom washer a distance sufficient to allow connection of the pivot bolt with the threaded aperture provided in the clutch pressure plate of the clutch assembly to be adjusted.

19 Claims, 2 Drawing Sheets

CLUTCH TENSION ADJUSTMENT TOOL

TECHNICAL FIELD

The present invention relates to tools and more particularly to a clutch tension adjustment tool for adjusting the tension on clutches that have a threaded aperture into a clutch pressure plate and a clutch adjustment ring for adjusting the tension of the clutch; the clutch tension adjustment tool including an elongated tool handle having a padded hand grip; a bolt slot plate with an elongated bolt slot; an S-shaped connecting bar integrally formed between the tool handle and the bolt slot plate; a clutch adjustment ring insertion pin extending downwardly and away from a far end of the bolt slot plate; arid a spring biased, slidable clutch plate connecting pivot bolt assembly slidably mounted through the bolt slot, the spring biased, slidable clutch plate connecting pivot bolt assembly including a pivot bolt with a threaded end portion, a moveable top washer, a moveable biasing spring, a moveable middle washer, and a fixed bottom washer; the threaded end portion of the pivot bolt being inserted through the moveable top washer, the moveable biasing spring, the moveable middle washer, the elongated bolt slot of the bolt slot plate and the fixed bottom washer, the fixed bottom washer being welded to a midpoint of the pivot bolt in a manner to allow at least a section of the threaded end portion to protrude past the fixed bottom washer a distance sufficient to allow connection of the pivot bolt with the threaded aperture provided in the clutch pressure plate of the clutch assembly to be adjusted.

BACKGROUND OF THE INVENTION

Adjusting the tension on some clutches tool for adjusting the tension on clutches that have a threaded aperture into a clutch pressure plate and a clutch adjustment ring for adjusting the tension of the clutch can be aggravating experience. The tension is typically adjusted by removing a clutch lock and then adjusting the tension by placing a chisel against the clutch adjustment ring and striking the chisel with a hammer. Although this method works, it often results in over or under adjustment of the clutch tension. It would be a benefit, therefore, to have a tool that could be used to adjust the clutch tension in a more predictable manner. It would also be a benefit to have a clutch tension adjustment tool that allowed a user to install a pivot bolt into the threaded aperture used to install the clutch lock and that included an adjustment pin that could be inserted into the clutch adjustment ring of the clutch and moved by pivoting the clutch tension adjustment tool about the a pivot bolt.

SUMMARY OF THE INVENTION

It is thus an object of the invention to provide a clutch tension adjustment tool.

It is a further object of the invention to provide a clutch tension adjustment tool that includes a pivot bolt that is installed into the threaded aperture used to install the clutch lock of the clutch assembly and that includes an adjustment pin that is inserted into the clutch adjustment ring of the clutch and moved by pivoting the clutch tension adjustment tool about the pivot bolt.

It is a still further object of the invention to provide a clutch tension adjustment tool that includes an elongated tool handle having a padded hand grip; a bolt slot plate with an elongated bolt slot; an S-shaped connecting bar integrally formed between the tool handle and the bolt slot plate; a clutch adjustment ring insertion pin extending downwardly and away from a far end of the bolt slot plate; and a spring biased, slidable clutch plate connecting pivot bolt assembly slidably mounted through the bolt slot, the spring biased, slidable clutch plate connecting pivot bolt assembly including a pivot bolt with a threaded end portion, a moveable top washer, a moveable biasing spring, a moveable middle washer, and a fixed bottom washer; the threaded end portion of the pivot bolt being inserted through the moveable top washer, the moveable biasing spring, the moveable middle washer, the elongated bolt slot of the bolt slot plate and the fixed bottom washer, the fixed bottom washer being welded to a midpoint of the pivot bolt in a manner to allow at least a section of the threaded end portion to protrude past the fixed bottom washer a distance sufficient to allow connection of the pivot bolt with the threaded aperture provided in the clutch pressure plate of the clutch assembly to be adjusted.

It is a still further object of the invention to provide a clutch tension adjustment tool that accomplishes some or all of the above objects in combination.

Accordingly, a clutch tension adjustment tool for adjusting the tension on clutches that have a threaded aperture into a clutch pressure plate and a clutch adjustment ring for adjusting the tension of the clutch is provided. The clutch tension adjustment tool includes an elongated tool handle having a padded hand grip; a bolt slot plate with an elongated bolt slot; an S-shaped connecting bar integrally formed between the tool handle and the bolt slot plate; a clutch adjustment ring insertion pin extending downwardly and away from a far end of the bolt slot plate; and a spring biased, slidable clutch plate connecting pivot bolt assembly slidably mounted through the bolt slot, the spring biased, slidable clutch plate connecting pivot bolt assembly including a pivot bolt with a threaded end portion, a moveable top washer, a moveable biasing spring, a moveable middle washer, and a fixed bottom washer; the threaded end portion of the pivot bolt being inserted through the moveable top washer, the moveable biasing spring, the moveable middle washer, the elongated bolt slot of the bolt slot plate and the fixed bottom washer, the fixed bottom washer being welded to a midpoint of the pivot bolt in a manner to allow at least a section of the threaded end portion to protrude past the fixed bottom washer a distance sufficient to allow connection of the pivot bolt with the threaded aperture provided in the clutch pressure plate of the clutch assembly to be adjusted.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
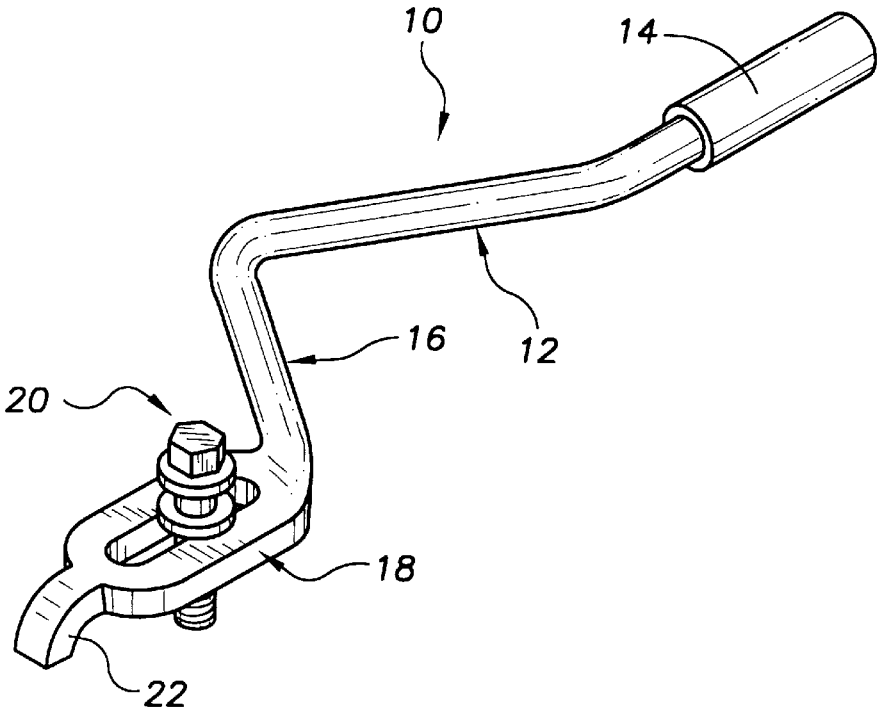
FIG. 1 is a perspective view of an exemplary embodiment of the clutch tension adjustment tool of the present invention showing the tool handle with the padded hand grip; the S-shaped connecting bar; the bolt slot plate with the elongated bolt slot; the spring biased, slidable clutch plate connecting pivot bolt assembly slidably mounted within the bolt slot; and the clutch adjustment ring insertion pin extending downwardly and away from the far end of the bolt slot plate.

FIG. 1 shows an exemplary embodiment of the clutch tension adjustment tool of the present invention generally designated by the numeral 10. Adjustment tool 10 includes an elongated tool handle, generally designated 12; a resilient rubber hand grip 14; an S-shaped connecting bar, generally designated 16; a bolt slot plate, generally designated 18; a spring biased, slidable clutch plate connecting pivot bolt assembly, generally designated 20; and a clutch adjustment ring insertion pin 22. In this embodiment, elongated tool handle 12, S-shaped connecting bar 16, bolt slot plate 18 and clutch adjustment ring insertion pin 22 are integrally cast of carbon steel.

Figure 2:
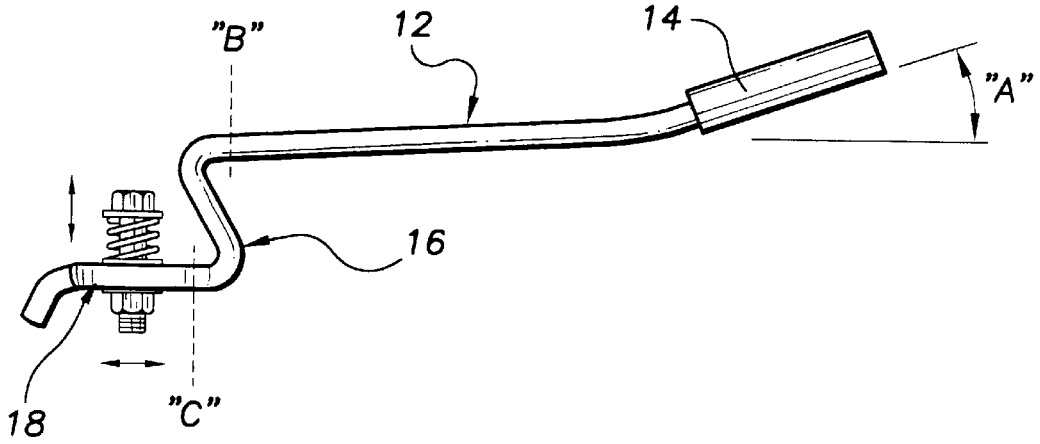
FIG. 2 is a side plan view of the exemplary clutch tension adjustment tool of the present invention showing the tool handle with the thirty degree upward bend "A" at the padded hand grip end; the S-shaped connecting bar (shown between the dashed lines "B" and "C" for clarity); the bolt slot plate; the spring biased, slidable clutch plate connecting pivot bolt assembly slidably mounted through the bolt slot of the bolt slot plate; and the clutch adjustment ring insertion pin extending downwardly and away from the far end of the bolt slot plate.
Figure 3:
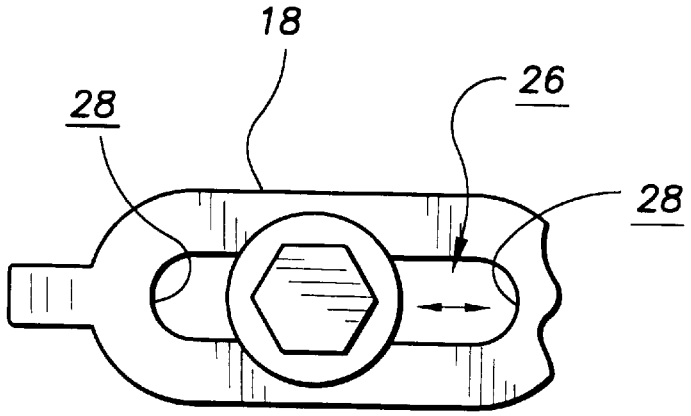
FIG. 3 is a detail top plan view of the elongated bolt slot formed through the bolt slot plate and the spring biased, slidable clutch plate connecting pivot bolt assembly mounted through the bolt slot.

With reference to FIG. 2, elongated tool handle 12 has a thirty degree upward bend "A" just before hand grip 14 in a manner such that hand grip 14 is oriented at a thirty degree angle with respect to the length of elongated handle 12. S-shaped connecting bar 16 is connected in a manner such that elongated handle 12 and bolt slot plate 18 are oriented substantially in parallel. With reference to FIG. 3, in this embodiment, bolt slot plate 18 has a two inch long bolt slot 26 formed therethrough that has two curved end portions 28.

Figure 4:
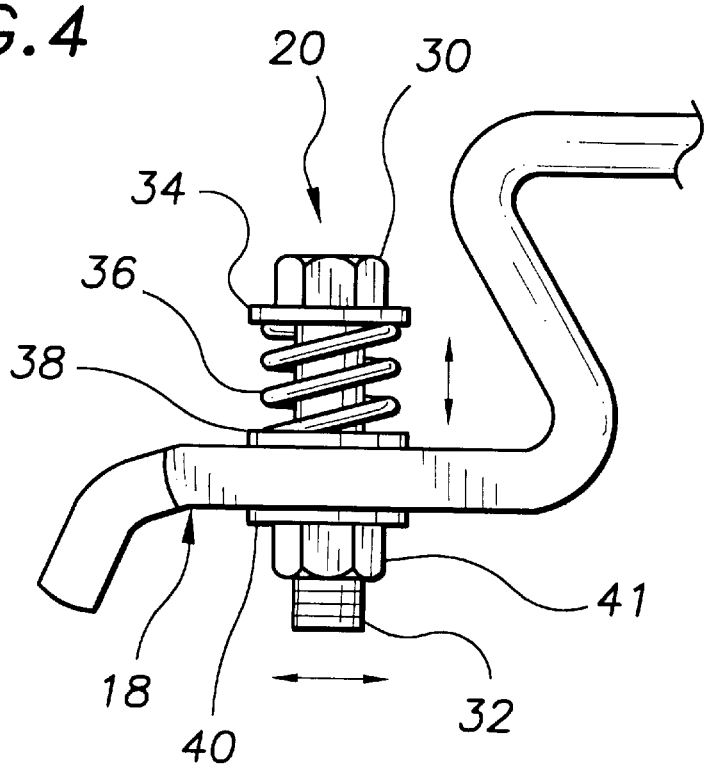
FIG. 4 is a detail side plan view of the S-shaped connecting bar integrally formed with the bolt slot plate; and the spring biased, slidable clutch plate connecting pivot bolt assembly including the pivot bolt with the threaded portion inserted through the moveable top washer, the moveable biasing spring, the moveable middle washer, the elongated bolt slot of the bolt slot plate and the fixed bottom washer, the fixed bottom washer being welded to a midpoint of the pivot bolt in a manner to allow a threaded portion to protrude past the fixed bottom washer for connecting with the threaded aperture provided in the clutch pressure plate of the clutch assembly to be adjusted.

With reference now to FIG. 4, spring biased, slidable clutch plate connecting pivot bolt assembly 20 includes a steel pivot bolt 30 with a threaded end portion 32, a moveable steel top washer 34, a moveable compression biasing spring 36, a moveable steel middle washer 38, and a fixed steel bottom washer 40. During assembly, threaded end portion 32 of pivot bolt 30 is inserted through moveable top washer 34, moveable biasing spring 36, moveable middle washer 38, elongated bolt slot 26 (FIG. 3) of bolt slot plate 18 and fixed bottom washer 40. Fixed bottom washer 40 is then permanently affixed to pivot bolt 30 by welding fixed bottom washer 40 to a securing nut 41 and then threading securing nut 41 onto pivot bolt 30 in a manner such that at least one-half Inch section of threaded end portion 32 extends past securing nut 41.

With general reference to FIGS. 1–4, in use clutch tension adjustment tool 10 is used by installing threaded end 32 of pivot bolt 30 into the threaded aperture of the clutch pressure plate used to install the clutch lock and inserting clutch adjustment ring insertion pin 22 into the clutch adjustment ring. The clutch tension is then easily adjusted by positioning the clutch adjustment ring by pivoting elongated handle 12 at pivot bolt 30.

It can be seen from the preceding description that a clutch tension adjustment tool has been provided that includes a pivot bolt that is installed into the threaded aperture used to install the clutch lock of the clutch assembly; that includes an adjustment pin that is inserted into the clutch adjustment ring of the clutch moved by pivoting the clutch tension adjustment tool about the pivot bolt; and that includes an elongated tool handle having a padded hand grip; a bolt slot plate with an elongated bolt slot; an S-shaped connecting bar integrally formed between the tool handle and the bolt slot plate; a clutch adjustment ring insertion pin extending downwardly and away from a far end of the bolt slot plate; and a spring biased, slidable clutch plate connecting pivot bolt assembly slidably mounted through the bolt slot, the spring biased, slidable clutch plate connecting pivot bolt assembly including a pivot bolt with a threaded end portion, a moveable top washer, a moveable biasing spring, a moveable middle washer, and a fixed bottom washer; the threaded end portion of the pivot bolt being inserted through the moveable top washer, the moveable biasing spring, the moveable middle washer, the elongated bolt slot of the bolt slot plate and the fixed bottom washer, the fixed bottom washer being welded to a midpoint of the pivot bolt in a manner to allow at least a section of the threaded end portion to protrude past the fixed bottom washer a distance sufficient to allow connection of the pivot bolt with the threaded aperture provided in the clutch pressure plate of the clutch assembly to be adjusted.

It is noted that the embodiment of the clutch tension adjustment tool described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A clutch tension adjustment tool for adjusting the tension on clutches that have a threaded aperture into a clutch pressure plate and a clutch adjustment ring for adjusting the tension of the clutch, the clutch tension adjustment tool comprising:

an elongated tool handle having a hand grip;

a bolt slot plate with an elongated bolt slot;

an S-shaped connecting bar connected between said tool handle and said bolt slot plate;

a clutch adjustment ring insertion pin extending downwardly and away from a far end of said bolt slot plate; and a spring biased, slidable clutch plate connecting pivot bolt assembly slidably mounted through said bolt slot, said spring biased, slidable clutch plate connecting pivot bolt assembly including a pivot bolt with a threaded end portion, a moveable top washer, a moveable biasing spring, a moveable middle washer, and a fixed bottom washer; said threaded end portion of said pivot bolt being inserted through said moveable top washer, said moveable biasing spring, said moveable middle washer, said elongated bolt slot of said bolt slot plate and said fixed bottom washer, said fixed bottom washer being permanently affixed to a midpoint of said pivot bolt in a manner to allow at least a section of said threaded end portion to protrude past said fixed bottom washer a distance of at least three-eighths of an inch.

2. The clutch tension adjustment tool of claim 1, wherein:

said S-shaped connecting bar is integrally formed with said tool handle and said bolt slot plate.

3. The clutch tension adjustment tool of claim 2, wherein:

said hand grip is constructed of a resilient material.

4. The clutch tension adjustment tool of claim 3, wherein:

said fixed bottom washer is held in place at said midpoint of said pivot bolt by a securing nut.

5. The clutch tension adjustment tool of claim 4 wherein:

said elongated tool handle, said bolt slot plate, said S-shaped connecting bar, and said clutch adjustment ring insertion pin are constructed of carbon steel.

6. The clutch tension adjustment tool of claim 5 wherein:

said elongated tool handle has a bend therein of an angle between twenty-five and thirty-five degrees.

7. The clutch tension adjustment tool of claim 4 wherein:

said elongated tool handle has a bend therein of an angle between twenty-five and thirty-five degrees.

8. The clutch tension adjustment tool of claim 3 wherein:

said elongated tool handle, said bolt slot plate, said S-shaped connecting bar, and said clutch adjustment ring insertion pin are constructed of carbon steel.

9. The clutch tension adjustment tool of claim 3 wherein:

said elongated tool handle has a bend therein of an angle between twenty-five and thirty-five degrees.

10. The clutch tension adjustment tool of claim 2 wherein:

said fixed bottom washer is held in place at said midpoint of said pivot bolt by a securing nut.

11. The clutch tension adjustment tool of claim 2 wherein:

said elongated tool handle, said bolt slot plate, said S-shaped connecting bar, and said clutch adjustment ring insertion pin are constructed of carbon steel.

12. The clutch tension adjustment tool of claim 2 wherein:

said elongated tool handle has a bend therein of an angle between twenty-five and thirty-five degrees.

13. The clutch tension adjustment tool of claim 1, wherein:

said hand grip is constructed of a resilient material.

14. The clutch tension adjustment tool of claim 13 wherein:

said fixed bottom washer is held in place at said midpoint of said pivot bolt by a securing nut.

15. The clutch tension adjustment tool of claim 13 wherein:

said elongated tool handle, said bolt slot plate, said S-shaped connecting bar, and said clutch adjustment ring insertion pin are constructed of carbon steel.

16. The clutch tension adjustment tool of claim 13 wherein:

said elongated tool handle has a bend therein of an angle between twenty-five and thirty-five degrees.

17. The clutch tension adjustment tool of claim 1 wherein:

said fixed bottom washer is head in place at said midpoint of said pivot bolt by a securing nut.

18. The clutch tension adjustment tool of claim 1 wherein:

said elongated tool handle, said bolt slot plate, said S-shaped connecting bar, and said clutch adjustment ring insertion pin are constructed of carbon steel.

19. The clutch tension adjustment tool of claim 1 wherein:

said elongated tool handle has a bend therein of an angle between twenty-five arid thirty-five degrees.

* * * * *